US009627745B2

(12) United States Patent
Hayashi et al.

(10) Patent No.: US 9,627,745 B2
(45) Date of Patent: Apr. 18, 2017

(54) ANTENNA DEVICE ATTACHED TO VEHICLE

(71) Applicant: HARADA INDUSTRY CO., LTD, Tokyo (JP)

(72) Inventors: Makoto Hayashi, Tokyo (JP); Toshiro Yokoyama, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/817,312

(22) Filed: Aug. 4, 2015

(65) Prior Publication Data

US 2016/0036121 A1 Feb. 4, 2016

(30) Foreign Application Priority Data

Aug. 4, 2014 (JP) ..... P2014-158802

(51) Int. Cl.
*H01Q 1/32* (2006.01)
*H01Q 1/42* (2006.01)

(52) U.S. Cl.
CPC ..... *H01Q 1/3275* (2013.01); *H01Q 1/42* (2013.01)

(58) Field of Classification Search
CPC ..... H01Q 1/42; H01Q 1/3275
USPC ..... 343/713, 711, 712, 872
See application file for complete search history.

(56) References Cited

U.S. PATENT DOCUMENTS 5,757,327 A * 5/1998 Yajima ..... H01Q 21/061 343/700 MS
2007/0046551 A1 3/2007 Tateno
2009/0066593 A1* 3/2009 Jared ..... H01Q 1/1214 343/713
2010/0231467 A1* 9/2010 Schnuerer ..... H01Q 1/3275 343/713
2010/0265147 A1 10/2010 Wakui et al.
2013/0229315 A1* 9/2013 Duzdar ..... H01Q 1/3275 343/713

FOREIGN PATENT DOCUMENTS

CN 202004161 U 10/2011
CN 203481372 U 3/2014
EP 2144327 A1 1/2010
EP 2790267 A1 10/2014
GB 2505117 A 2/2014
JP 2005-020660 A 1/2005
(Continued)

OTHER PUBLICATIONS

Search report issued by the British Patent Office on Nov. 5, 2015, which corresponds to Great Britain Patent Application No. 1513656.7 and is related to U.S. Appl. No. 14/817,312.
(Continued)

*Primary Examiner* — Hoanganh Le
(74) *Attorney, Agent, or Firm* — Studebaker & Brackett PC

(57) ABSTRACT

An antenna device attached to a vehicle includes a base to which an antenna is fixed, a cover that is attached to the base, and a flexible pad that covers and supports an edge of the base, contacts an edge of the cover, and is located between the vehicle and the cover. A protrusion is provided on a surface of the pad on the cover side, and includes a body portion formed along the edge of the base, and a plurality of rib-like portions extending from the body portion to an edge of the pad.

5 Claims, 6 Drawing Sheets

(56) References Cited

FOREIGN PATENT DOCUMENTS

| | | | |
|---|---|---|---|
| JP | 2006-237917 | A | 9/2006 |
| JP | 3859630 | B2 | 12/2006 |
| JP | 2008-182663 | A | 8/2008 |
| JP | 2010-021856 | A | 1/2010 |
| JP | 2013-005127 | A | 1/2013 |
| JP | 2014-033461 | A | 2/2014 |
| KR | 20100005791 | | 6/2010 |

OTHER PUBLICATIONS

A Notice of Allowance issued by the Japanese Patent Office on Jul. 26, 2016, which corresponds to Japanese Patent Application No. 2014-158802 and is related to U.S. Appl. No. 14/817,312.

An Office Action, "Patents Act 1977: Examination Report under Section 18(3)," issued by the Intellectual Property Office of the United Kingdom on Nov. 11, 2016, which corresponds to GB Patent Application No. 1513656.7 and is related to U.S. Appl. No. 14/817,312.

* cited by examiner

ANTENNA DEVICE ATTACHED TO VEHICLE

TECHNICAL FIELD

The present disclosure relates to an antenna device attached to a vehicle.

BACKGROUND

An antenna device that transmits and receives radio waves used for a radio broadcast, a GPS, an ETC, or the like is attached to a vehicle such as a car. In Japanese Patent No. 3859630, an antenna device which includes a flexible pad attached to a base on which an antenna and a circuit board are placed, and a cover which covers the circuit board, and the like, and which is attached to an outer plate of the vehicle is described. Since an edge of the cover and the pad in the antenna device are appressed to each other, it is possible to enhance a waterproof property of an internal space of the cover.

SUMMARY

Since the above-described pad has flexibility, a part of the pad may be bent and may intrude the internal space of the cover. Accordingly, water-tightness of the pad of the antenna device may not be maintained. Further, it is not preferable in the appearance of the antenna device that the part of the pad intrudes the internal space of the cover.

An aspect of the present invention provides an antenna device capable of preventing a pad from intruding an internal space of a cover.

An antenna device attached to a vehicle according to an aspect of the present invention includes a base to which an antenna is fixed; a cover attached to the base; and a pad having flexibility, the pad covering and supporting an edge of the base, contacting an edge of the cover, and being located between the vehicle and the cover, wherein a protrusion is provided on a surface of the pad on the cover side, and wherein the protrusion includes a body portion formed along the edge of the base, and a plurality of rib-like portions extending from the body portion to an edge of the pad.

According to this antenna device, due to the plurality of rib-like portions provided on the surface of the pad on the cover side, the strength of the pad from the body portion to the edge increases, and it is difficult for the pad to be bent. Therefore, it is possible to suppress incursion of the pad into an internal space of the cover. Further, since the plurality of rib-like portions are provided on the pad, it is possible to suppress an increase in the weight and an increase in material costs as compared to a case in which the thickness of the entire pad increases.

Further, projections may be provided on an inner surface of the cover, the projections contacting the plurality of rib-like portions when the cover is attached to the base. In this case, it is possible to suppress bending of the pad, and suppress incursion of the pad into an internal space of the cover.

Further, the projection provided on the inner surface of the cover may have a plate shape. In this case, since an area of the projections contacting the plurality of rib-like portions increases, it is possible to suppress bending of the pad.

Further, a thick portion extending from the body portion of the protrusion to the edge of the pad may be provided on the surface of the pad, and a thickness of a portion of the pad in which the thick portion is provided may be larger than that of a portion between the plurality of rib-like portions. In this case, the strength of the pad in a portion in which the thick portion is provided increases, and it is difficult for the pad to be bent.

Further, the pad may include a region located between the base and the vehicle, n openings into which screws fixing the vehicle, the pad, and the base to each other are inserted may be provided in the region, the n openings may be adjacent to the body portion of the protrusion, n rib-like portions among the plurality of rib-like portions may respectively extend from regions of the body portion adjacent to the n openings to the edge of the pad, and n may be an integer equal to or greater than 1. If the n openings described above are provided in the pad, regions of the pad around the n openings have small strength and are easily bent. Here, since n rib-like portions among the plurality of rib-like portions respectively extend from the regions of the body portion of the protrusion adjacent to the n openings, degradation of the strength of the regions of the pad around the n openings is suppressed. Therefore, it is possible to suppress bending of the regions of the pad around the openings.

DETAILED DESCRIPTION

Hereinafter, an embodiment of the present invention will be described in detail with reference to the accompanying drawings. In the following description, the same elements, or elements having the same functions will be denoted with the same reference signs, and repeated description will be omitted.

Figure 1:
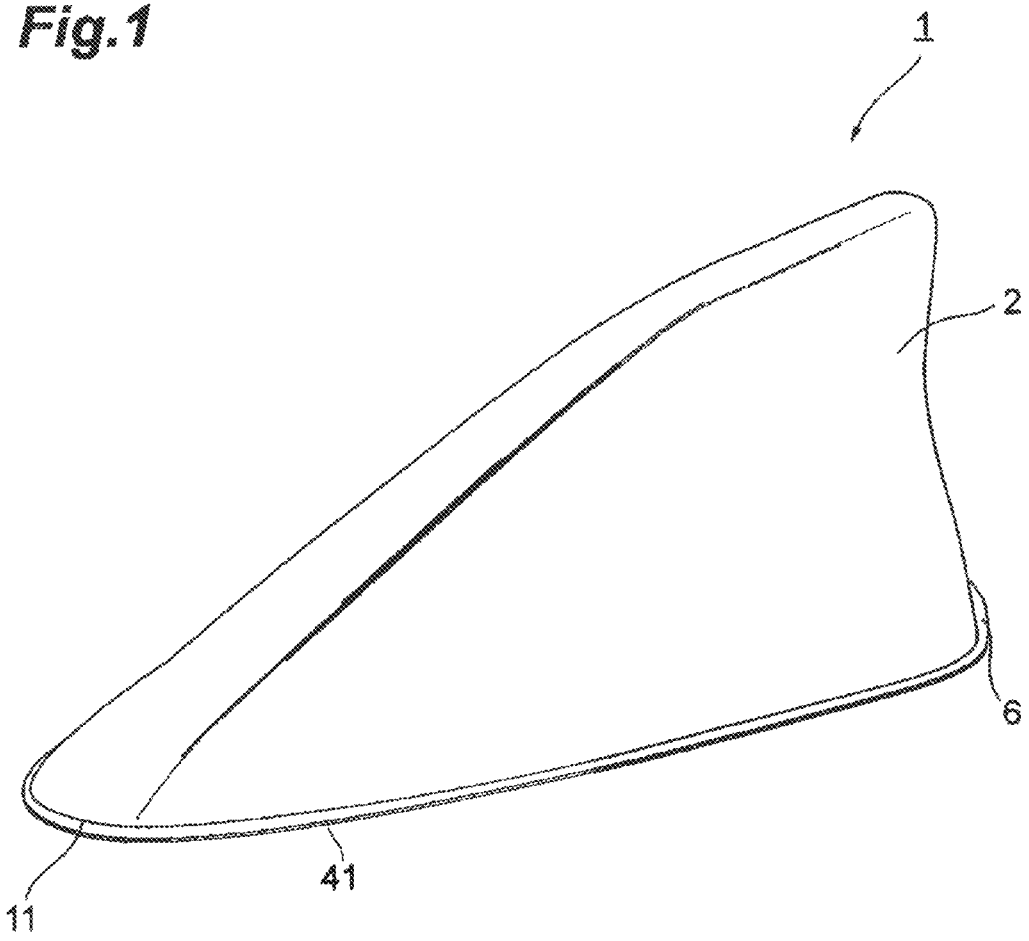
FIG. 1 is a perspective view of an antenna device according to an embodiment of the present invention.
Figure 2:
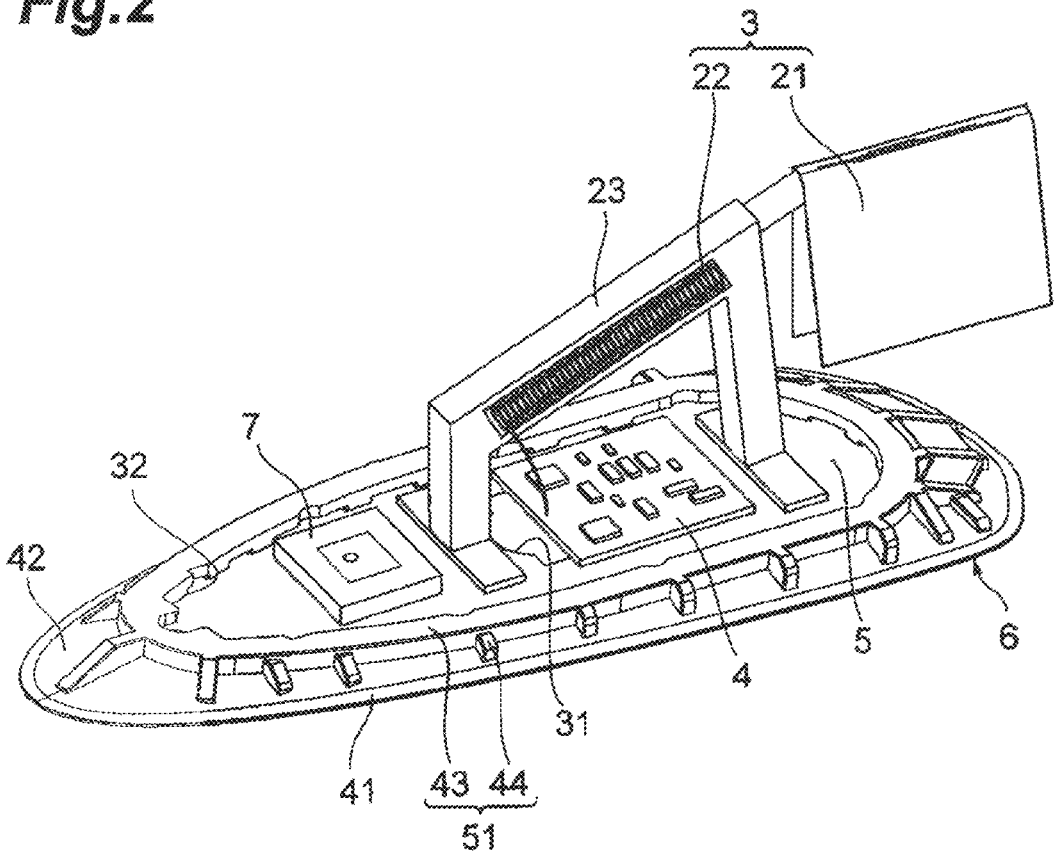
FIG. 2 is a schematic perspective view illustrating the inside of the antenna device according to the present embodiment.

FIG. 1 is a perspective view illustrating an antenna device according to the present embodiment. FIG. 2 is a schematic perspective view illustrating the inside of the antenna device according to the present embodiment. As illustrated in FIGS. 1 and 2, an antenna device 1 is a device that includes a cover 2, an antenna 3, a circuit board 4, a base 5, and a pad 6, and is attached to a roof or the like of a vehicle. In the following description, in the antenna device 1 and parts constituting the antenna device 1, it is assumed that a forward direction of the vehicle is a front end side, and a backward direction of the vehicle is a rear end side. Further, in the antenna device 1 and the parts constituting the antenna device 1, a side attached to the vehicle is assumed to be a lower side.

The cover 2 is formed of, for example, a resin which transmits radio waves, and covers at least the antenna 3, the circuit board 4, and the base 5. The cover 2 has a streamline shape (shark fin shape) having a height gradually lowered from the rear end side to the front end side. A distance between both side surfaces of the cover 2 is substantially constant from an upper end to the vicinity of a center portion, and gradually increases from the center portion to a lower end. The cover 2 is attached to the base 5 using, for example, a plurality of screws. An edge 11 of the cover 2 contacts the pad 6.

The antenna 3 includes a first antenna 21 and a second antenna 22, and is fixed onto, for example, the base 5 by an antenna stand 23 formed of an insulating resin. The first antenna 21 and the second antenna 22 are formed of a conductive material, such as a metal or an alloy, and transmit and receive, for example, a signal in an AM wave band and an FM wave band. The first antenna 21 is attached to an upper end side of the antenna stand 23. By arranging the first antenna 21 in a high position as above, electrical characteristics of the first antenna 21 are improved. The second antenna 22 is provided in the antenna stand 23. The second antenna 22 is formed in a coil shape, one end thereof is connected to the first antenna 21, and the other end is connected to the circuit board 4.

The circuit board 4 is fixed to the base 5, and a signal received by the antenna 3 is input to the circuit board 4. For example, in the circuit board 4, an integrated circuit, a capacitor, and the like are provided, and amplification or the like of the signal received by the antenna 3 is performed. The circuit board 4 and the first antenna 21 may not overlap each other in a plan view. In this case, it is possible to improve reception performance. A cable (not illustrated) or the like is connected to the circuit board 4, and the circuit board 4 is connected to an electronic device in the vehicle via the cable or the like.

The base 5 is, for example, a stand formed of a metal, an alloy, or a resin, and the cover 2, the antenna 3, and the circuit board 4 are fixed to the base 5, as described above. The base 5 has a substantially egg-shape or a substantially elliptical shape in a plan view, and is sized to be accommodated in the edge 11 of the cover 2. An opening 31 is formed in a central portion of the base 5. The cable or the like connected to the circuit board 4 is inserted into, for example, the opening 31. Further, a plurality of screw holes in which screws for fixing the vehicle, the cover 2, the antenna 3, and the like are inserted are provided in the base 5. When the base 5 is formed of a metal or an alloy, a region of the base 5 overlapping the first antenna 21 in a plan view may be reduced. When the region is small, parasitic capacitance formed by the first antenna 21 and the base 5 can be reduced. When the base 5 is formed of a metal or an alloy, a size of the base 5 in the plan view can be minimized. As the size of the base 5 decreases, a weight of the antenna device 1 decreases, and a material cost of the base 5 is reduced. If the base 5 is formed of a resin, the base 5 may not be flexible.

In the base 5, a patch antenna 7 is provided on the front end side relative to the antenna 3. The patch antenna 7 transmits and receives radio waves used for, for example, a GPS or an ETC. That is, the patch antenna 7 transmits and receives radio waves different from those in the first antenna 21. The patch antenna 7 is connected to, for example, the circuit board 4 or the electronic device in the vehicle via a cable (not illustrated) or the like.

The pad 6 is formed of, for example, a flexible resin such as rubber, and is a member in the antenna device 1 that contacts a surface of the vehicle. The pad 6 is attached to the base 5 so as to cover and support an edge 32 of the base 5, and is sized to be located between the vehicle and the cover 2. In particular, as illustrated in FIG. 1, an edge 41 of the pad 6 is located on an outward side relative to the cover 2, and the pad 6 and the edge 11 of the cover 2 are appressed to each other. Accordingly, water is prevented from intruding an internal space of the cover 2 from between the pad 6 and the edge 11 of the cover 2.

Figure 3:
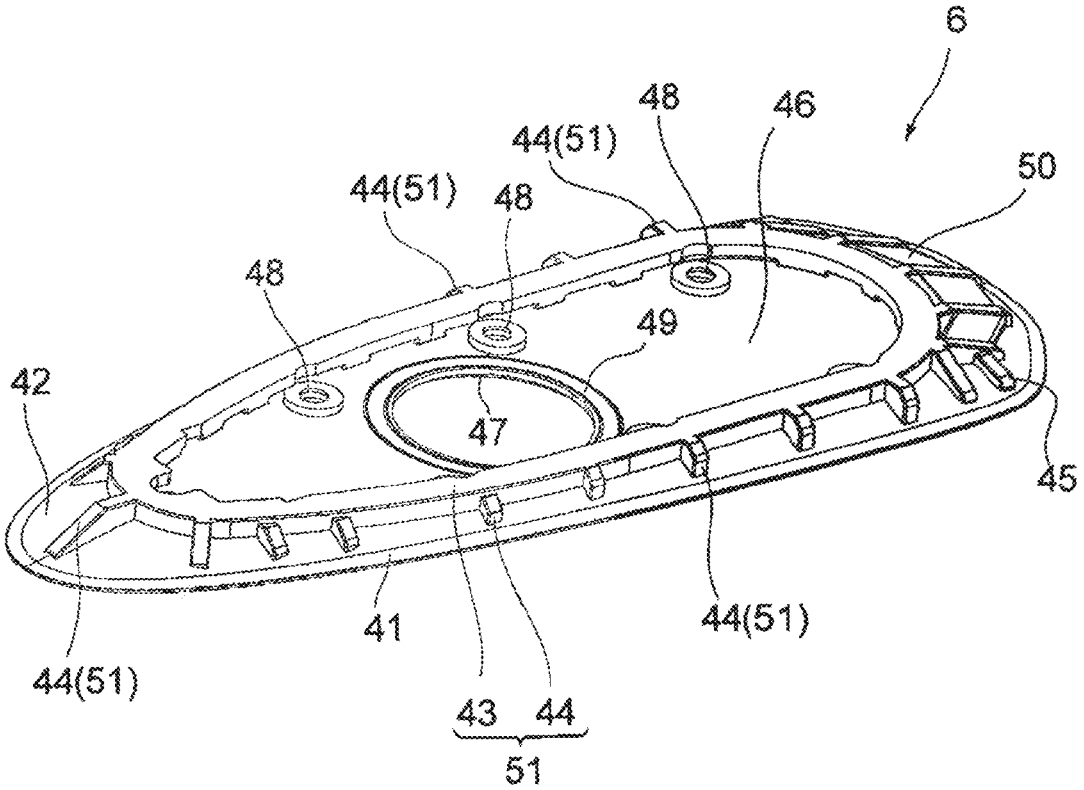
FIG. 3 is a perspective view of a pad.
Figure 4:
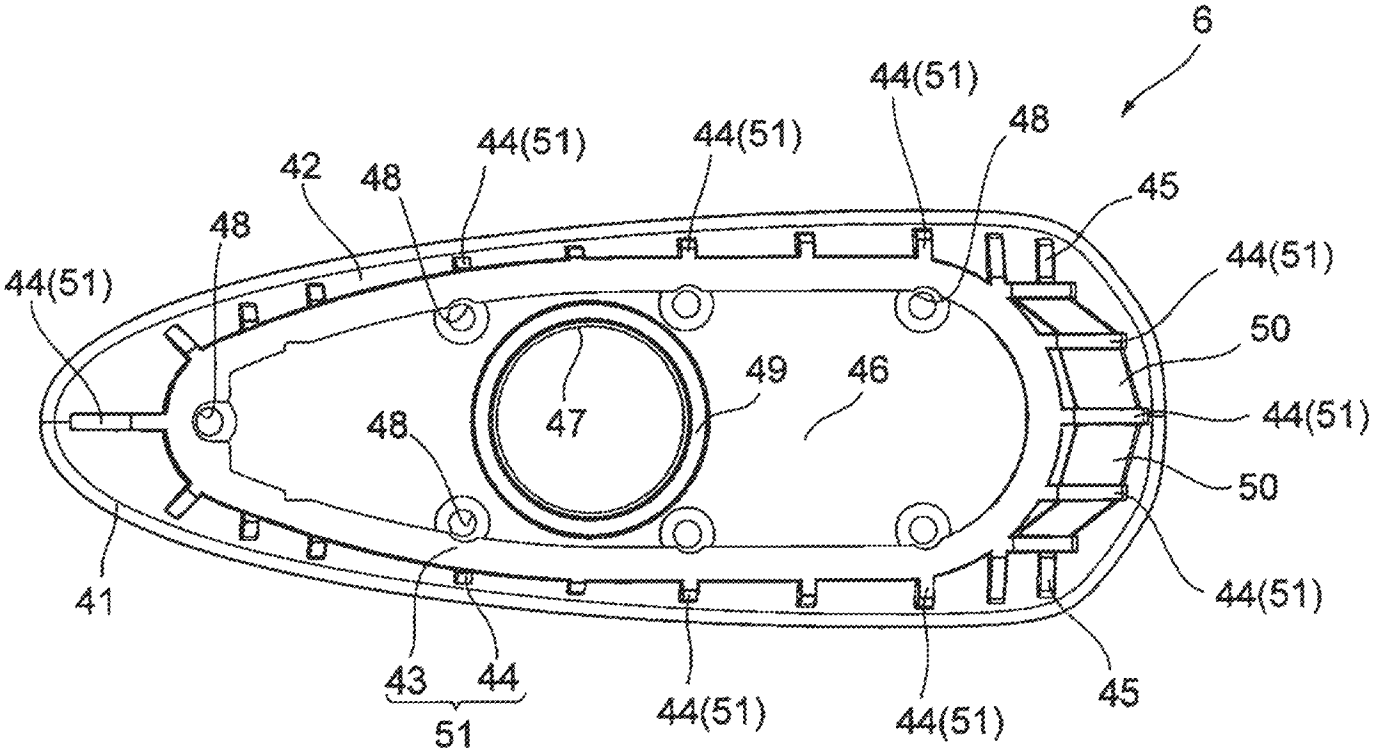
FIG. 4 is a plan view of the pad.
Figure 5:
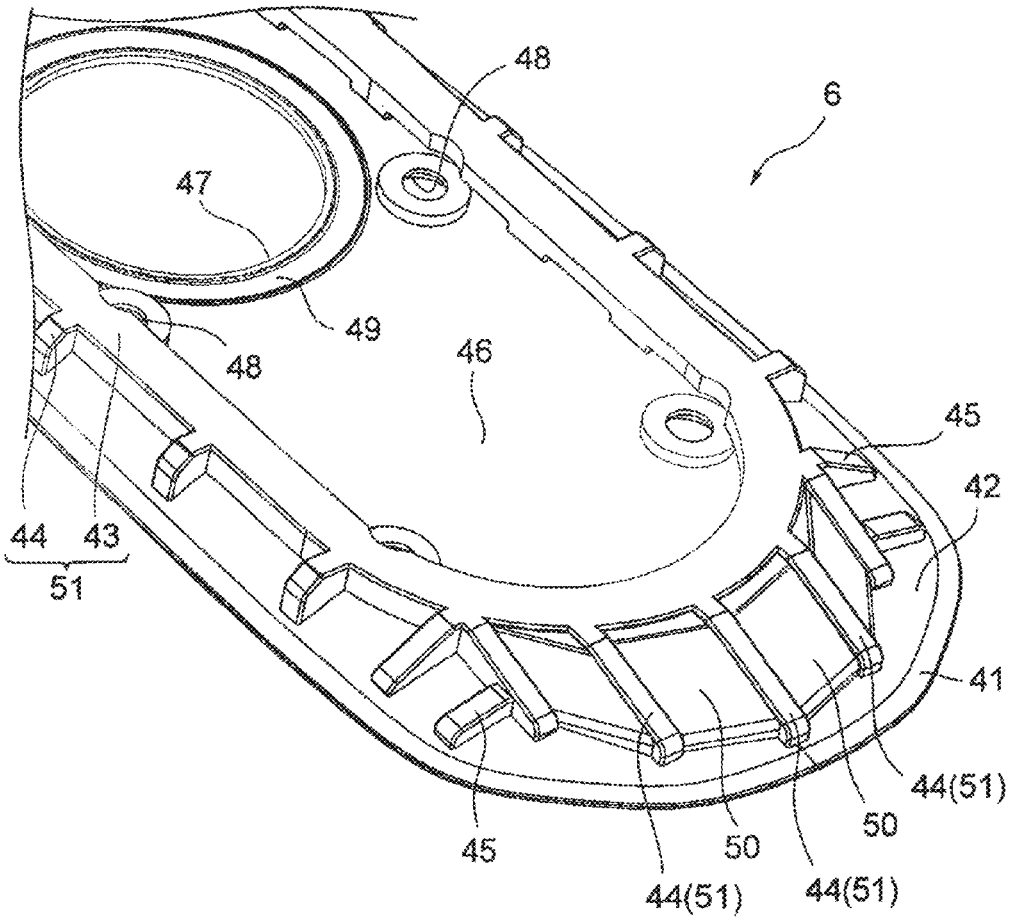
FIG. 5 is an enlarged view of a part of the pad.

Next, a shape of the pad 6 will be described in detail with reference to FIGS. 3 to 5. FIG. 3 is a perspective view of the pad 6. FIG. 4 is a plan view of the pad 6. FIG. 5 is an enlarged view of a part of the pad 6. A surface 42 of the pad 6 in FIGS. 3 to 5 is a surface on which the cover 2 and the base 5 are placed (cover side), as illustrated in FIG. 2, and a rear surface of the pad 6 is a surface on the vehicle side.

As illustrated in FIGS. 3 to 5, a protrusion 51 including a body portion 43 and a plurality of rib-like portions 44 is provided on the surface 42 of the pad 6. The protrusion 51 protrudes from the surface 42 of the pad 6. In the pad 6, a thickness of a portion in which the protrusion 51 is provided is larger than that of a portion in which the protrusion 51 is not provided. The body portion 43 of the protrusion 51 is formed along the edge 32 of the base 5 (see FIG. 2), and has a substantially elliptical and annular shape in a plan view. The body portion 43 is provided on the surface 42 of the pad 6, and is pressed against an annular rib 12 having a substantially elliptical and annular shape provided on an inner surface of the cover 2 to be described below (see FIG. 6). Accordingly, when water invades the internal space of the cover 2 from between the pad 6 and the edge 11 of the cover 2, the water is prevented from reaching the circuit board 4, the base 5, and the like. As illustrated in FIG. 2, the base 5 is attached so as to set in the body portion 43 of the pad 6.

As illustrated in FIGS. 3 to 5, each of the plurality of rib-like portions 44 of the protrusion 51 extends in a straight line shape from the body portion 43 to the edge 41 of the pad 6. A thickness of a portion of each of the plurality of rib-like portions 44 is reduced toward the edge 41 of the pad 6 so as not to obstruct attachment of the cover 2 to the base 5. That is, in each of the plurality of rib-like portions 44, an inclined portion that is inclined toward the edge 41 of the pad 6 is provided. A front end side of the inclined portion may be rounded. A portion between the inclined portion in each of the plurality of rib-like portions 44 and the body portion 43 has a substantially columnar shape. A front end surface of each of the plurality of rib-like portions 44 of the pad 6 is formed substantially perpendicular to the surface of the pad 6. Although the number of the plurality of rib-like portions 44 is not limited but, for example, the rib-like portions 44 may be provided along the periphery of the body portion 43.

In some of the plurality of rib-like portions 44, branched portions 45 are provided. Each of these rib-like portions 45 extends toward the edge 41 of the pad 6 in a direction different from that of the rib-like portion 44 before being branched. Since such rib-like portions 45 are provided, it is possible to increase the strength of the pad 6 between the rib-like portions 44. In this embodiment, the rib-like portions 45 are provided on the rear end side of the pad 6.

A region 46 in the pad 6 on an inward side relative to the body portion 43 is a region located between the base 5 and the vehicle. Since this region 46 is provided, the vehicle is prevented from being damaged due to contact between the vehicle and the base 5. In the region 46, an opening 47 overlapping the opening 31 (see FIG. 2) provided in the base 5, and a plurality of openings 48 arranged in a direction along the body portion 43 are formed. The opening 47 is formed in a central portion of the pad 6, and the cable or the like is inserted into the opening 47, similar to the opening 31 of the base 5. Around the opening 47, a ring portion 49 for suppressing the intrusion of water into the opening 47 is formed. The ring portion 49 is a part of the pad 6. In the pad 6, a thickness of a portion in which the ring portion 49 is provided is larger than that of a portion in which the ring portion 49 is not provided. Further, a thickness of the ring portion 49 is smaller than that of the body portion 43.

Each of the plurality of openings 48 is provided to be adjacent to the body portion 43 of the protrusion 51. For example, screws for fixing the vehicle, the pad 6, the base 5, and the cover 2 to each other are inserted into the plurality of openings 48. Further, at least one rib-like portion 44 extends toward the edge 41 of the pad 6 from each of regions of the body portion 43 adjacent to the plurality of openings 48.

A thick portion 50 extending from the body portion 43 to the edge 41 of the pad 6 is provided on the rear end side relative to the body portion 43 in the surface 42 of the pad 6. The thick portion 50 is provided between the plurality of rib-like portions 44. In the thick portion 50, an inclined portion that is inclined toward the edge 41 of the pad 6 is provided, similar to the plurality of rib-like portions 44. In the pad 6, the thickness of the portion in which the thick portion 50 is provided is larger than that of a portion in which the thick portion 50 is not provided (for example, between the plurality of rib-like portions 44). The thickness of the thick portion 50, for example, is equal to or smaller than those of the plurality of rib-like portions 44.

Figure 6:
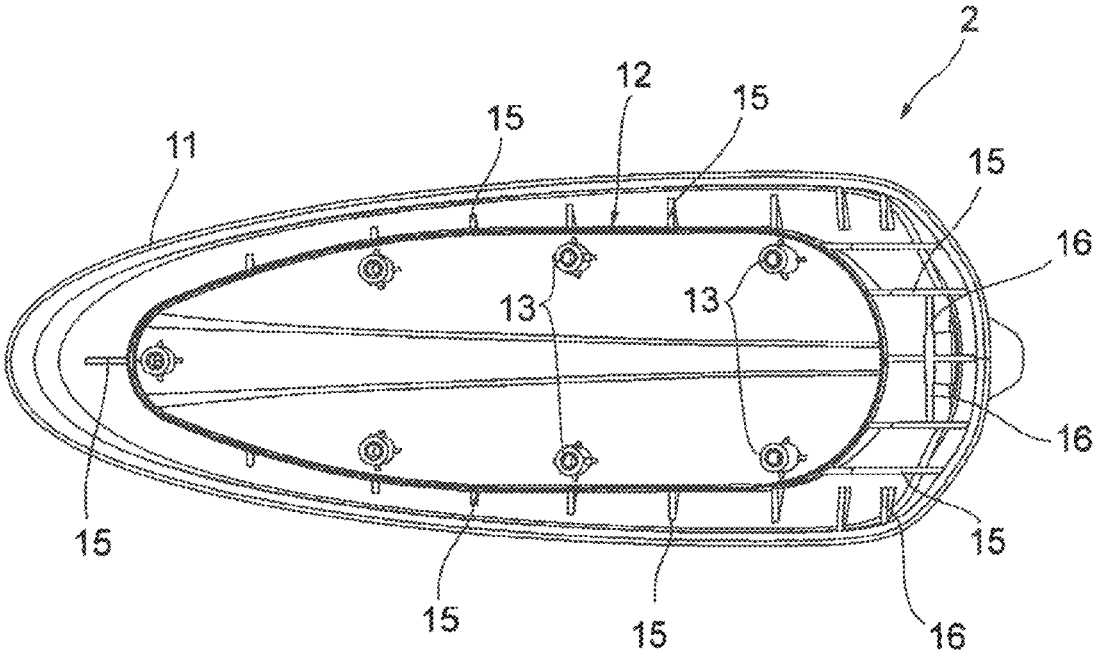
FIG. 6 illustrates a bottom view of a cover.

Next, an internal structure of the cover 2 will be described with reference to FIG. 6. FIG. 6 illustrates a bottom view of the cover. As illustrated in FIG. 6, an annular rib 12, a plurality of screw holes 13, a plurality of ribs (projections) 15 and 16 provided between the inner surface of the cover 2 and the annular rib 12 are provided on the inner surface of the cover 2.

The annular rib 12 is a projection formed of, for example, the same material as that of the cover 2 and having a substantially elliptical and annular shape in a plan view. The annular rib 12 has a shape corresponding to the shape of the body portion 43 of the protrusion 51 in the pad 6 (see FIGS. 3 and 4). Accordingly, the annular rib 12 contacts the body portion 43 when the cover 2 is attached to the base 5 to which the pad 6 has been attached. Screws are inserted into the plurality of screw holes 13, the base 5 and the cover 2 are fixed by the screws, and accordingly, the annular rib 12 is pressed against and appressed to the body portion 43. Thus, since the annular rib 12 is appressed to the body portion 43, water can be prevented from intruding into the base 5.

The plurality of ribs 15 are provided on the inner surface of the cover 2, and formed integrally with the annular rib 12. Each of the plurality of ribs 15 is a plate-like projection extending in a straight line shape from the annular rib 12 to the edge 11 of the cover 2. The plurality of ribs 15 are formed corresponding to positions in which the rib-like portions 44 (see FIGS. 3 and 4) of the protrusion 51 in the pad 6 are provided. The plurality of ribs 15 contact the plurality of rib-like portions 44 when the cover 2 is attached to the base 5 to which the pad 6 is attached. Since the plurality of ribs 15 are provided between the inner surface of the cover 2 and the annular rib 12, the strength of the annular rib 12 increases.

The plurality of ribs 16 are formed of the same material as that of the annular rib 12 and is provided on the inner surface of the cover 2. The plurality of ribs 16 are plate-like projections which extend in a straight line shape without coming in contact with the annular rib 12. The plurality of ribs 16 are formed corresponding to positions in which the rib-like portions 45 or the thick portions 50 (see FIGS. 3 to 5) are provided in the pad 6. Some of the plurality of ribs 16 may contact the rib-like portions 45 when the cover 2 is attached to the base 5 to which the pad 6 is attached. Further, others of the plurality of ribs 16 may contact the thick portions 50.

Effects obtained by the antenna device 1 according to the present embodiment described above will be described. For example, if the rib-like portions 44 of the protrusion 51 illustrated in FIG. 3 or the like are not provided, a part of the flexible pad (particularly, the vicinity the edge of the pad) may be bent and may intrude the internal space of the cover. Accordingly, water-tightness of the pad may not be maintained. Further, it is not preferable in the appearance of the antenna device that the part of the pad intrudes the internal space of the cover. In order to prevent the pad from intruding the internal space, for example, an increase in a total thickness of the pad is considered. In this case, a weight of the pad increases, and a cost of a material forming the pad increases.

On the other hand, according to the antenna device 1 of the present embodiment, the pad 6 attached to the base 5 and contacting the edge 11 of the cover 2 is provided. The protrusion 51 is provided on the surface 42 of the pad 6 on the cover 2 side. The protrusion 51 includes the body portion 43 formed along the edge 32 of the base 5, and the plurality of rib-like portions 44 extending from the body portion 43 to the edge 41 of the pad 6. In this case, due to the plurality of rib-like portions 44, the strength of the pad 6 from the body portion 43 to the edge 41 increases, and it is difficult for the pad 6 to be bent. Thus, it is possible to prevent the pad 6 from intruding the internal space of the cover 2 without damaging the appearance of the antenna device 1. In addition, since the plurality of rib-like portions 44 are provided in the pad 6, it is possible to suppress an increase in the weight and the material costs, unlike the case in which a total thickness of the pad 6 increases.

Further, the plurality of ribs (projection) 15 that contact the plurality of rib-like portions 44 when the cover 2 is attached to the base 5 may be provided on the inner surface of the cover 2. In this case, the plurality of ribs 15 provided on the inner surface of the cover 2 can suppress bending of the pad 6 and prevent the pad 6 from intruding the internal space of the cover 2.

Further, the plurality of ribs (projections) 15 provided on the inner surface of the cover 2 may have a plate shape. In this case, since an area of the plurality of ribs 15 respectively contacting the plurality of rib-like portions 44 increases, it is possible to suppress bending of the pad 6.

Further, the thick portions 50 extending from the body portion 43 of the protrusion 51 to the edge 41 of the pad 6 are provided on the surface 42 of the pad 6, and the thickness of the pad 6 in which the thick portions 50 are provided may be larger than the thickness of the pad 6 between the plurality of rib-like portions 44. In this case, the strength of the pad 6 in portions in which the thick portions 50 are provided increases, and it is further difficult for the pad 6 to be bent.

The thick portion 50 may be provided in a position in which a distance between the edge 41 of the pad 6 and the body portion 43 is large. In such a location, the pad 6 easily intrudes the internal space of the cover 2. Accordingly, by providing the thick portion 50 in the above part of the pad 6, it is possible to effectively prevent the pad 6 from intruding the internal space of the cover 2. Further, since the ribs 16 that may contact the thick portions 50 are provided on the inner surface of the cover 2, it is possible to more effectively prevent the pad 6 from intruding the internal space of the cover 2.

Further, the pad 6 includes the region 46 located between the base 5 and the vehicle, the plurality of openings 48 into which the screws fixing the vehicle, the pad 6, and the base 5 to each other are inserted are provided in the region 46, the plurality of openings 48 are adjacent to the body portion 43 of the protrusion 51, and some of the plurality of rib-like portions 44 may extend from corresponding regions of the body portion 43 adjacent to the plurality of openings 48 to the edge 41 of the pad 6. When the plurality of openings 48 described above are provided in the pad 6, the regions of the pad 6 around the plurality of openings 48 have small strength and are easily bent. Here, since the some of the plurality of rib-like portions 44 respectively extend from the region 46 of the body portion 43 of the protrusion 51 adjacent to the plurality of openings 48, degradation of the strength of the regions of the pad 6 around the plurality of openings 48 is suppressed. Therefore, it is possible to suppress bending of the regions of the pad 6 around the openings 48.

When the base 5 of the antenna device 1 is formed of a conductive material such as a metal or an alloy, the size of the base 5 in the plan view may be minimized. Accordingly, the weight of the antenna device 1 is reduced, and costs of the material of the base 5 are reduced. Here, in order to maintain close contact between the pad 6 and the cover 2, it is necessary to increase the area of the pad 6 in the plan view. In this case, a distance from the body portion 43 of the protrusion 51 to the edge 41 in the pad 6 increases, and the region from the body portion 43 to the edge 41 in the pad 6 is easily bent. However, since the protrusion 51 (particularly, the plurality of rib-like portions 44) is provided on the surface 42 of the pad 6, it is possible to suppress bending of the pad 6 in the above region. Thus, according to this embodiment, it is possible to achieve both of a small size of the base 5 and prevention of the pad 6 from intruding the internal space of the cover 2.

The antenna device according to an aspect of the present invention is not limited to the above-described embodiments, and various other modifications can be made. For example, the antenna 3 of the above embodiment may not necessarily be covered with the cover 2. Further, the number and the shape of the plurality of rib-like portions 44 or the like are not necessarily limited to the above embodiments. Further, the patch antenna 7 may not necessarily be attached to the base 5, or may not be included in the antenna device 1.

Further, the circuit board 4 in the above embodiment may not necessarily be provided on the base 5. In this case, the circuit board 4 may be provided, for example, under a roof of the vehicle. Further, the projections that are the plurality of ribs 15 in the above embodiment may not necessarily function as ribs. For example, the projection may have a columnar shape extending from the inner surface of the cover 2 to the pad 6. The projection in this case may have, for example, a substantially cylindrical shape or a substantially square columnar shape.

What is claimed is:

1. An antenna device attached to a vehicle, the antenna device comprising:

a base to which an antenna is fixed;

a cover attached to the base; and a pad having flexibility, the pad covering and supporting an edge of the base, contacting an edge of the cover, and being located between the vehicle and the cover, wherein a protrusion is provided on a surface of the pad on the cover side, and wherein the protrusion includes a body portion formed along the edge of the base, and a plurality of rib-like portions extending from the body portion to an edge of the pad.

2. The antenna device according to claim 1, wherein projections are provided on an inner surface of the cover, the projections contacting the plurality of rib-like portions when the cover is attached to the base.

3. The antenna device according to claim 2, wherein each of the projections has a plate shape.

4. The antenna device according to claim 1, wherein a thick portion extending from the body portion of the protrusion to the edge of the pad is provided on the surface of the pad, and wherein a thickness of a portion of the pad in which the thick portion is provided is larger than that of a portion between the plurality of rib-like portions.

5. The antenna device according to claim 1, wherein the pad includes a region located between the base and the vehicle, wherein n openings into which screws fixing the vehicle, the pad, and the base to each other are inserted are provided in the region, wherein the n openings are adjacent to the body portion of the protrusion, wherein n rib-like portions among the plurality of rib-like portions respectively extend from regions of the body portion adjacent to the n openings to the edge of the pad, and wherein n is an integer equal to or greater than 1.

* * * * *